US006460256B2

(12) United States Patent
Peppel et al.

(10) Patent No.: US 6,460,256 B2
(45) Date of Patent: Oct. 8, 2002

(54) ERGONOMIC POULTRY KNIFE

(75) Inventors: Alan S. Peppel, Charlton; Laurie A. Lapierre, Southbridge, both of MA (US)

(73) Assignee: Dexter-Russel, Inc., Southbridge, MA (US)

( * ) Notice: Subject to any disclaimer, the term of this patent is extended or adjusted under 35 U.S.C. 154(b) by 0 days.

(21) Appl. No.: 09/976,730

(22) Filed: Oct. 12, 2001

(65) Prior Publication Data

US 2002/0023359 A1 Feb. 28, 2002

Related U.S. Application Data

(62) Division of application No. 09/607,703, filed on Jun. 30, 2000.

(51) Int. Cl.[7] ..... B25G 1/10
(52) U.S. Cl. ..... 30/340; 30/342
(58) Field of Search ..... 30/340, 341, 342; D22/118; D7/649

(56) References Cited

U.S. PATENT DOCUMENTS 1,754,543 A * 4/1930 Callum ..... 16/431
2,421,339 A * 5/1947 Leger ..... 16/430
2,538,442 A * 1/1951 Christie ..... 30/165
D186,021 S * 9/1959 Lamb ..... D7/649
D226,410 S * 2/1973 Kunze ..... D7/649
4,038,719 A * 8/1977 Bennett ..... 16/430
D250,082 S * 10/1978 Breger ..... D7/649
4,147,348 A * 4/1979 Lee ..... 16/DIG. 12
4,155,550 A * 5/1979 Planakis ..... 473/526
D271,320 S * 11/1983 Ferraro ..... D22/118
D295,011 S * 4/1988 Herron et al. ..... D22/118
D337,022 S * 7/1993 Sheets ..... D7/401.2
D397,190 S * 8/1998 Balolia ..... D22/118
5,791,055 A * 8/1998 Mangol ..... 30/340
D402,856 S * 12/1998 Cohen et al. ..... D7/649
5,850,663 A * 12/1998 Hardy et al. ..... 15/236.01
D424,380 S * 5/2000 McCatty ..... D7/649
D448,253 S * 9/2001 Staib, Jr. et al. ..... D7/649

* cited by examiner

*Primary Examiner*—Allan N. Shoap
*Assistant Examiner*—Stephen Choi
(74) *Attorney, Agent, or Firm*—Lackenbach Siegel, LLP

(57) ABSTRACT

An ergonomic poultry knife has an elongated handle having a longitudinal axis an upper surface, and a lower surface in a plane about parallel to the longitudinal axis, a blade receiving distal end, and a depending wall about perpendicular to the longitudinal axis to engage the upper surface of the index finger and wherein the wall is substantially more distant from the distal end than the recess, and a blade upper edge adjacent the distal end disposed about 1° to 6° downwardly with respect to the longitudinal axis.

10 Claims, 8 Drawing Sheets

ERGONOMIC POULTRY KNIFE

This applicationis a division of application Ser. No. 09/607,703, filed Jun. 30, 2000.

BACKGROUND OF THE INVENTION

1. Field of the Invention

This invention relates to knife handles. Specifically this invention relates to ergonomic knife handles. More specifically, this invention relates to an ergonomic poultry knife and handle.

2. Background and Discussion of the Prior Art

The art attempted to design knives with easy to grip handles. Examples of such knife handles are shown in FIGS. 1A–1B; 2A–2B, 3A–3B, 4A–4B and 5A–5B (Prior Art 1–5 handles). Prior Art 1–5 handles were less than fully successful attempts at providing for thumb and index finger engaging surfaces as well as closed palm engaging surfaces for support and comfort particularly in repetitive use. These diverse attempts did not provide the desired ergonomic effect. and comfort, and particularly in protracted repetitive poultry operations.

Poultry operators in particular would grip the handle and place their thumb on the right or left side of the handle, depending on their being right or left handed, in their quest for improved comfort, support and control.

While Prior Art 1–5 handles provided some comfort and improvement in use, the poultry operator's hand and wrist became unduly fatigued with repetitive use. In particular, Prior Art 1–5 handles did not provide adequate universal support and protection for the thumb. Some prior art handles did not provide sufficient thumb and index finger protection so that with fatigue the thumb would tend to slide off the handle and engage the knife blade.

The art sought a poultry knife and handle which ergonomically relieved stress and reduced hand and wrist fatigue with repetitive use. Specifically, the art desired a handle as aforesaid which ergonomically accommodated the poultry operators indexfinger, thumb and palm, and also universally ergonomically accommodated and protected the thumb and index finger regardless of the direction in which the operator's thumb was positioned, and particularly so with extended repetitive use.

SUMMARY OF THE INVENTION

The ergonomic handle has a combination of specifically contoured surfaces and spatially related features including: a proximate end, a knife receiving distal end, an upper grip surface and an oppositely disposed lower grip surface, and oppositely disposed side grip surfaces, with the lower grip surface formed with an index finger engaging surface, and the upper surface formed with a thumb engaging surface, and particularly including in combination with one or more of the following;

(i) the side grip surfaces have respective thumb engaging surfaces to provide universal ergonomic thumb support and protection;

(ii) each aforesaid thumb engaging surface has a like thumb guard portion which is substantially more distally disposed than the index finger engaging surface;

(iii) the distal end has a shallow arcuate surface extending to and contiguous with the respective distal portions of the side thumb guard portions;

(iv) the handle has a central axis, and the index finger engaging surface has a planar portion disposed about perpendicular to the central axis;

(v) the distal end shallow arcuate surface has a radial center disposed in plane perpendicularly disposed to the central axis, which plane is disposed in about the middle of each aforesaid thumb engaging surface; and (vi) the upper surface proximately disposed of the thumb engaging surface is formed to contour the palm of a closed hand.

In one specific aspect, the invention is an ergonomic poultry knife with a handle as aforesaid including a knife blade having an upper edge which is angularly downwardly disposed about 1° to 6°, and preferably about 3° to a horizontal axis. The combination of the ergonomic handle and the downwardly disposed knife handle provides a specifically useful embodiment of the ergonomic poultry knife.

DESCRIPTION OF THE PREFERRED EMBODIMENT

Figure 1A:
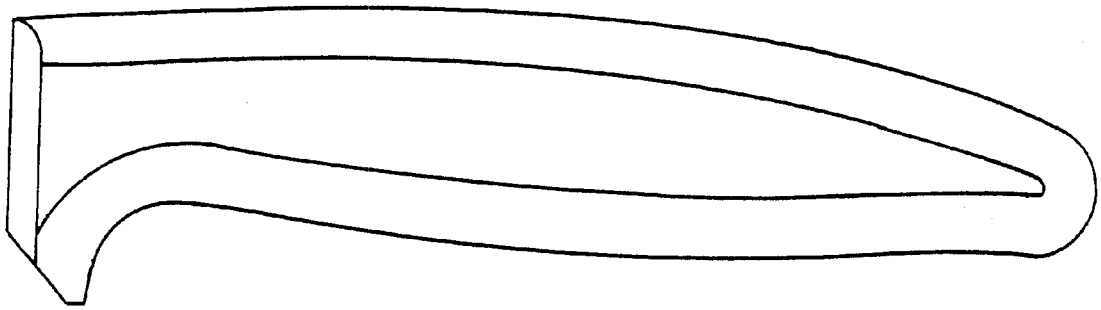
FIG. 1A PRIOR ART
FIG. 1A is a side elevational view of Prior Art No. 1 handle.
Figure 1B:
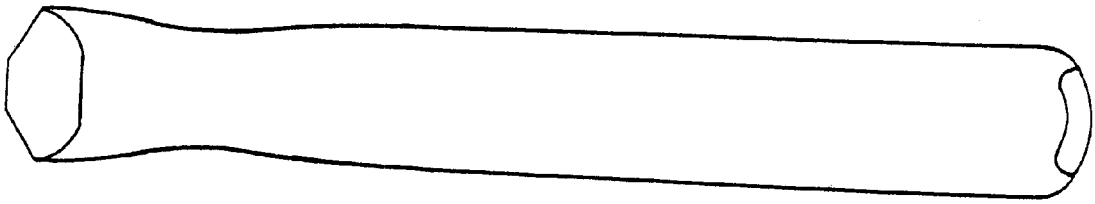
FIG. 1B PRIOR ART
FIG. 1B is a top plan view of the Prior Art No. 1 handle of FIG. 1A.
Figure 2A:
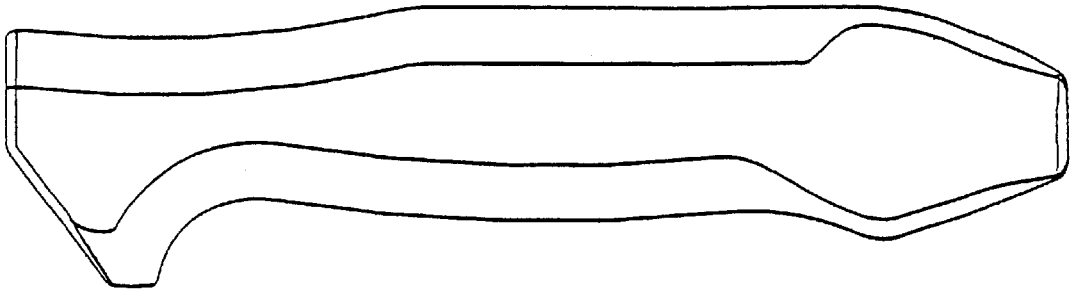
FIG. 2A PRIOR ART
FIG. 2A is a side elevational view of Prior Art No. 2 handle.
Figure 2B:
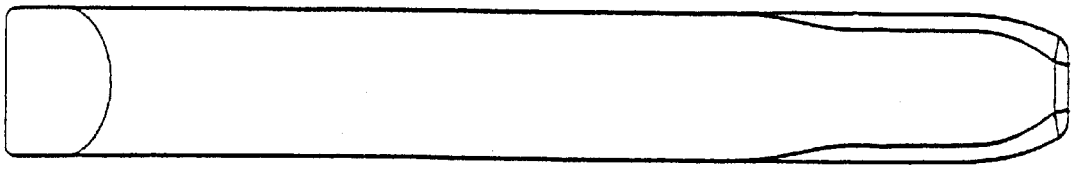
FIG. 2B PRIOR ART
FIG. 2B is a top plan view of the Prior Art No. 2 handle of FIG. 2A.
Figure 3A:
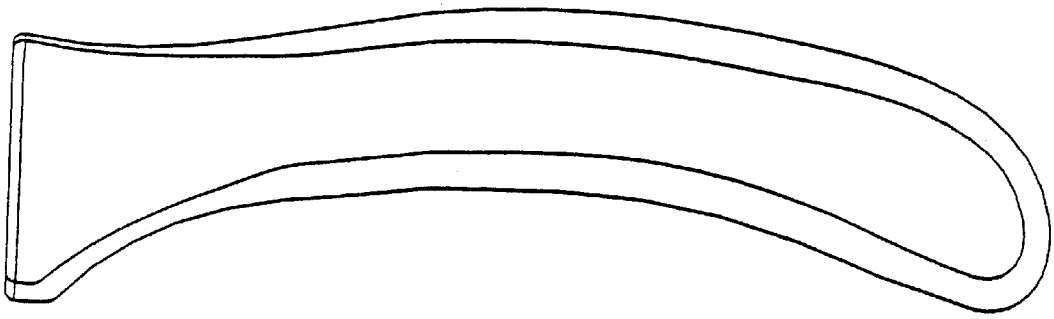
FIG.3A PRIOR ART
FIG. 3A is a side elevational view of Prior Art No. 3 handle.
Figure 3B:
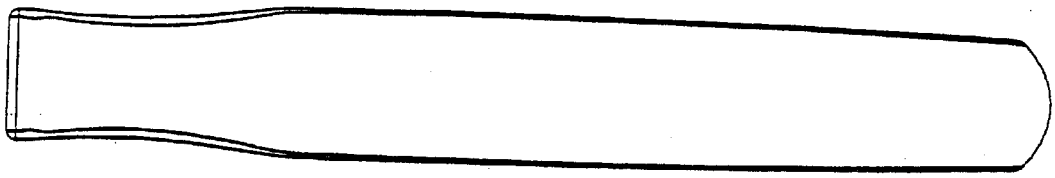
FIG.3B PRIOR ART
FIG. 3B is a top plan view of the Prior Art No. 3 handle of FIG. 3A.
Figure 4A:
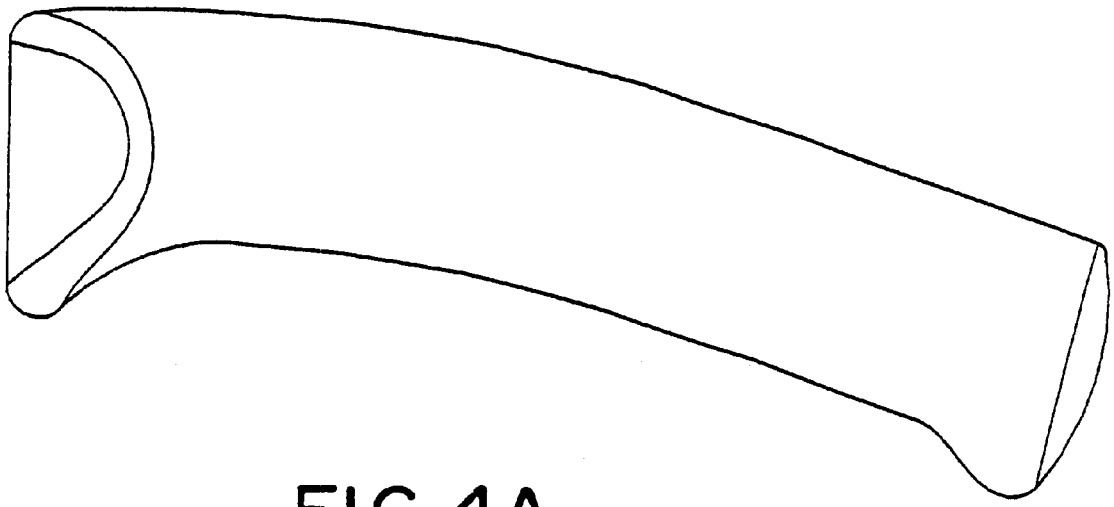
FIG. 4A PRIOR ART
FIG. 4A is a side elevational view of Prior Art No. 4 handle.
Figure 4B:
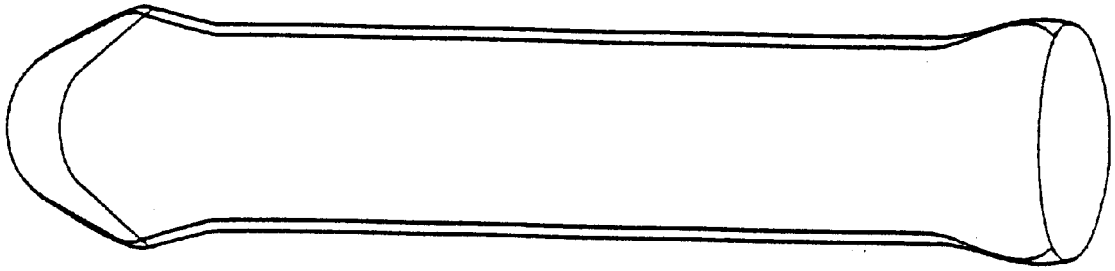
FIG. 4B PRIOR ART
FIG. 4B is a top plan view of the Prior Art No. 4 handle of FIG. 4A.
Figure 5A:
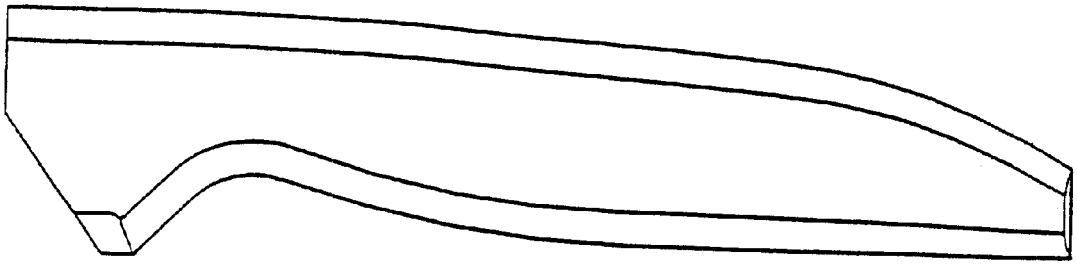
FIG. 5A PRIOR ART
FIG. 5A is a side elevational view of Prior Art No. 5 handle.
Figure 5B:
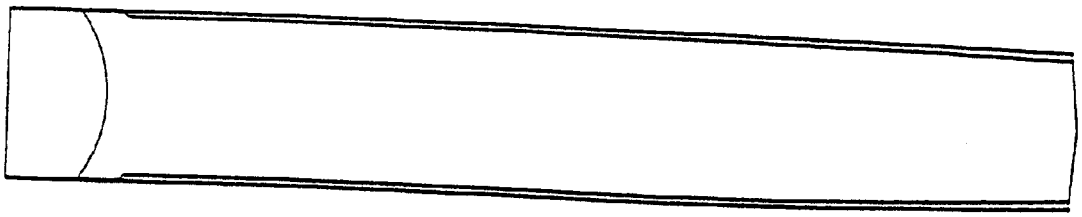
FIG. 5B PRIOR ART
FIG. 5B is a top plan view of the Prior Art No. 5 handle of FIG. 5A.

Referring to FIGS. 6–11C, the poultry knife 10 of the present invention has ergonomic handle 11 and knife blade 12. Blade 12 is fixedly secured within slot 42 of handle 11 by means well known in the art. Handle 11 is of molded plastic construction.

Handle 11 has, in general terms, an upper grip surface 13 and an oppositely disposed lower grip surface 14, oppositely disposed side grip surfaces 15 and 16, a curved proximate end 17, a blade 12 receiving distal end 18, distally angularly disposed lower surface 25, and horizontally disposed surface distal bottom 26 contiguous with lower grip surface 14. Handle 11 is elongated and has a central elongated or horizontal axis 24 (FIGS. 6, 7, 11B and 11C). Upper grip surface 13 is formed with a distally disposed pronounced concave thumb engaging surface 19 which extends distally to upper distal edge 20. Upper grip surface 13 is also formed with a proximately disposed elongated palm engaging surface 21. Surface 21 is contoured to conform to the palm of the user when gripping handle 11, as will be further explained hereinafter.

Lower grip surface 14 generally extends from distally disposed bottom surface 26 to proximately disposed bottom end surface 27. Lower grip surface 14 importantly has a prominent vertically disposed planar index finger receiving guard surface 30. Index finger guard surface 30 is disposed in plane 52. Surface 30 extends from bottom horizontally disposed surface 26, with which it is about perpendicularly disposed, to concave transitional recess 31, which recess 31 in turn is contiguous to and with the last three fingers engaging downwardly disposed proximately sloped surface 32. Surface 32 in turn extends proximately to and terminates at proximate bottom end surface 27. Proximate bottom end surface 27 and distally disposed bottom surface 26 are disposed in about plane 28. Plane 52 is about perpendicular to plane 28. Plane 52 is also about perpendicular to central horizontal axis 24 (FIG. 6).

Figure 7:
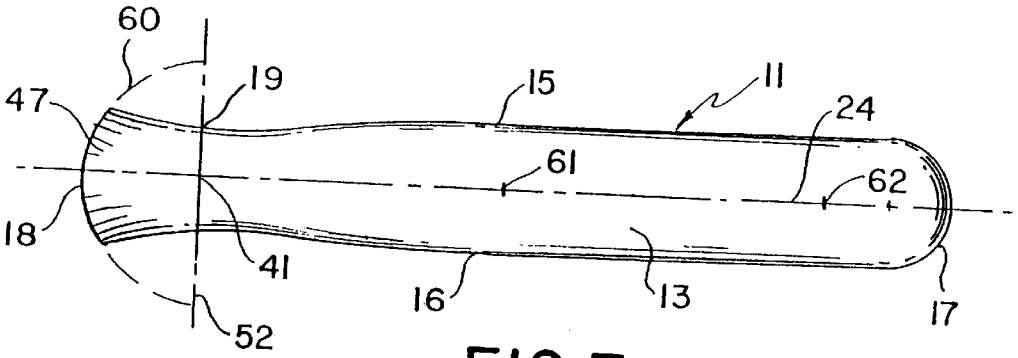
FIG. 7 is a fragmentary top plan view of the poultry knife handle of FIG. 6.
Figure 10:
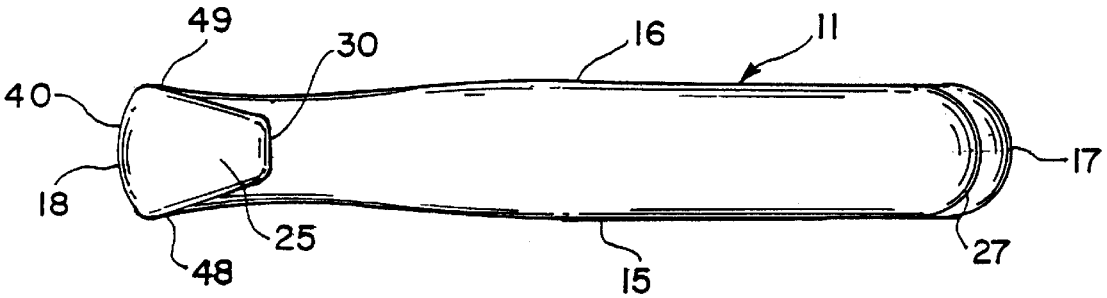
FIG. 10 is a bottom view of the poultry knife handle of FIG. 6.
Figure 11A:
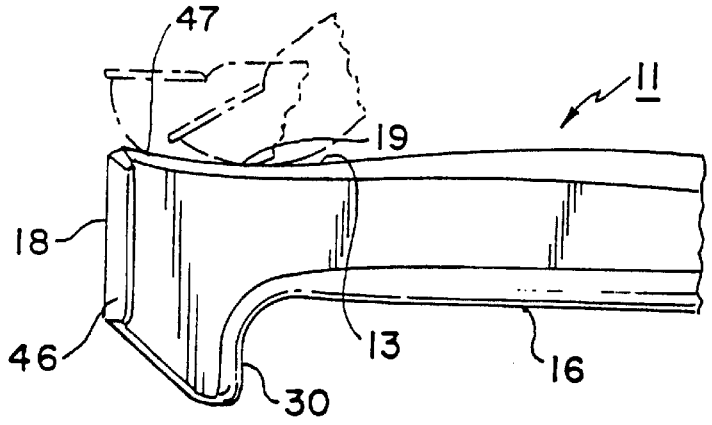
FIG. 11A is a partial fragmentary side view of the poultry knife handle of FIG. 6 showing the thumb engaging upper surface.
Figure 11B:
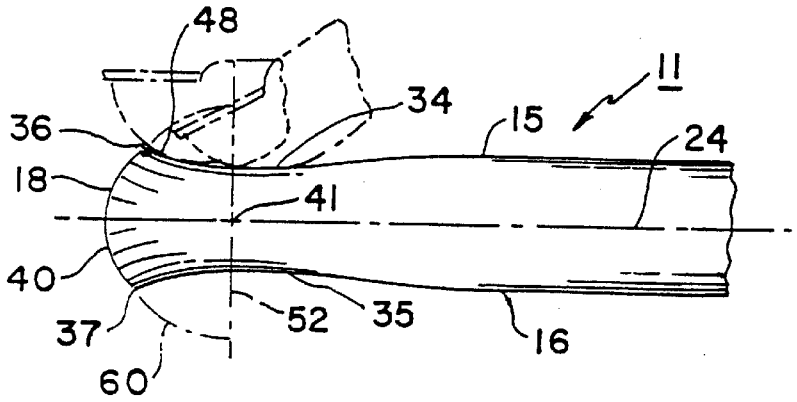
FIG. 11B is a partial fragmentary top plan view of the handle of FIG. 6 showing a left thumb engaging surface.
Figure 11C:
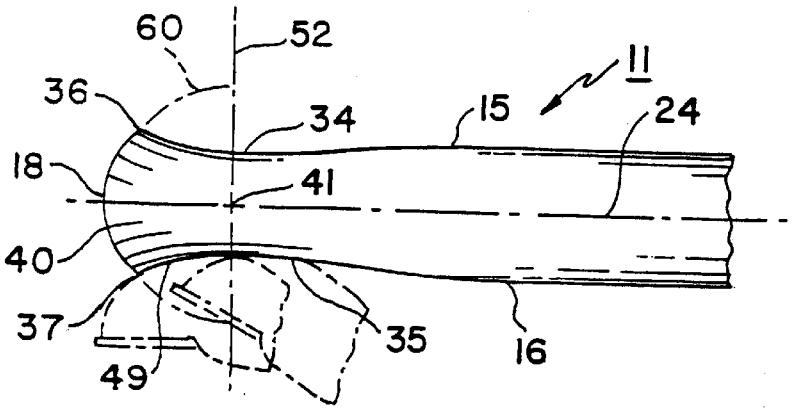
FIG. 11C is a partial fragmentary top plan view of the handle of FIG. 6 showing a right thumb engaging surface.

Side grip surfaces 15 and 16 are disposed in about parallel planes (FIGS. 7 and 10). Side grip surfaces 15 and 16 are formed with respective distally disposed thumb engaging concave surfaces 34 and 35. Side grip surfaces 34 and 35 extend distally to respective oppositely disposed distal side edges 36 and 37. Distal end 18 is formed with convex arcuate surface 40 which extends in a shallow arc 60 to side edges 36 and 37. Radial center 41 circumscribes arc 60 of arcuate distal end surface 40. Radial center 41 lies in a plane 52 which is perpendicularly disposed to the central axis 24. Plane 52 bisects, i.e. disposed in about the middle of, each respective thumb engaging surface 19, 34 and 35. The pronounced side thumb engaging surfaces 34 and 35 are in part formed by shallow arcuate surface 40 extending to side grip surfaces 15 and 16. The side thumb engaging surfaces 34 and 35 permit the left or right handed user to grip the knife in alternative modes (FIGS. 11A–11C). Respective thumb engaging surfaces 19, 34 and 35, have respective distally disposed thumb guard portions 47, 48 and 49. In this manner of construction, the user has an ergonomically positioned and guarded thumb when used in any of the elected alternate positions, as best shown in FIGS.11A–11C. Handle 11 provides three essentially equal ergonomical thumb positions with essentially equal distally disposed thumb guard positions. The index finger engaging planar surface 30 is importantly substantially more proximately disposed of each of the three thumb guard portions 47, 48 and 49 (See FIGS. 10 and 11A). In this manner of construction there is a positive index finger guard as well as a universal positive thumb guard to insure safety and comfort.

The upper grip palm engaging surface 21 extends proximately from about point 58 on upper grip surface 13 to point 59 at about proximate end 17, and provides an elongated curved approximately pistol-shaped surface that matches the closed palm when the user grips handle 11 in the afore-described manner. In this manner of construction, the hand or palm pressure is evenly distributed at the portions of the afore-described surfaces where the handle contacts the palm.

Figure 6:
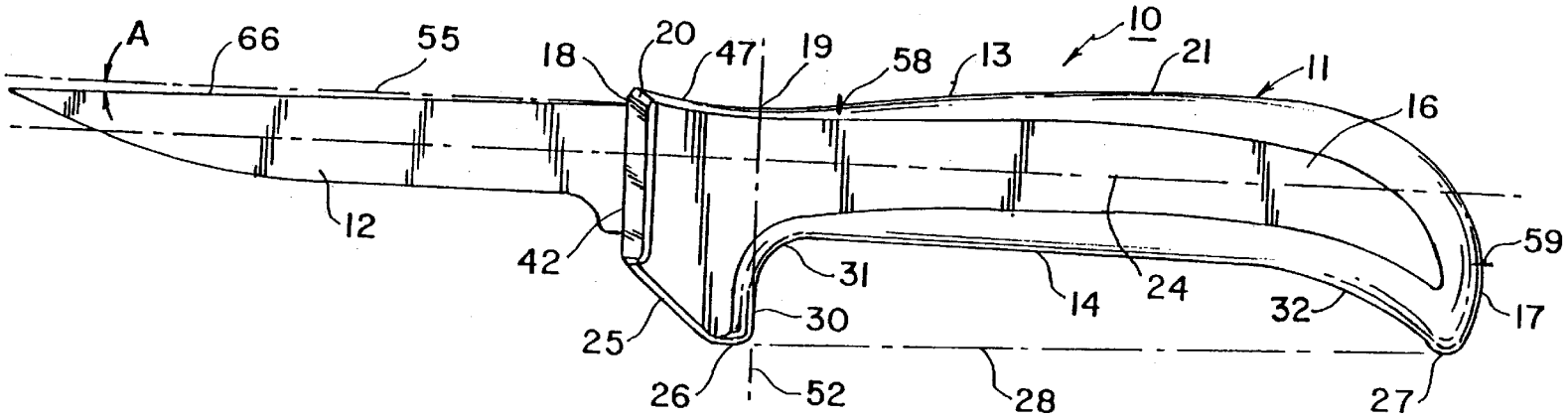
FIG. 6 is a side elevational view of the ergonomic poultry knife of the present invention.
Figure 8:
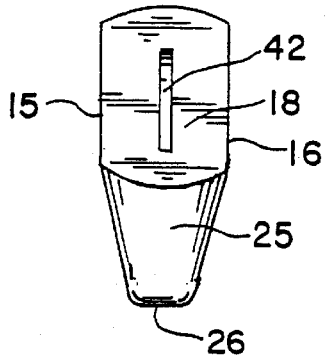
FIG. 8 is a distal end view of the poultry knife handle of FIG. 6.
Figure 9:
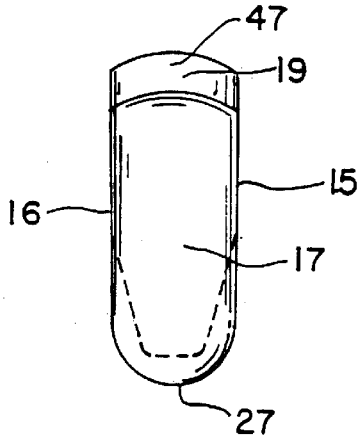
FIG. 9 is a proximate end view of the poultry knife handle of FIG. 6.

The invention contemplates another embodiment which is the poultry knife(FIG. 6). In this latter preferred embodiment, poultry knife blade 12 is formed with an upper edge 66 which is angularly downwardly disposed such as with respect to upper horizontal axis 55. This knife blade 12 disposition is downwardly disposed at angle A (FIG. 6), which angle A is preferably between about 1° and 6° from the upper horizontal axis, and most preferably about 30. This blade disposition in conjunction with the other afore-described handle aspects provides one specific improved poultry knife having ergonomic support providing reduced stress and fatigue.

Extended upper grip surface 21 between points 61 and 62 provides a liberal scribing monogram area of about 2⅔" by ½" (FIG. 7). This liberal scribing area is still another improvement and advantage of the present construction.

The handle is preferably manufactured of anti-grip polymeric material such as ribbed GripTex which repels poultry fat and sebaceous oils thereby providing a more secure anti-slip grip.

The terms "shallow arc" or "substantially shallow arc" as used hereinbefore and hereinafter throughout the specification and claims refer to an arc of less than about 90°, and preferably less than about 45°.

It is apparent that many modifications and variations of this invention as hereinbefore set forth may be made without departing from the spirit and scope thereof. The specific embodiments described are given by way of example only and the invention is limited only by the terms of the appended claims.

What is claimed is:

1. An ergonomic poultry knife comprising:

a handle having a proximate end and a distal end, an upper surface and an oppositely disposed lower surface, and oppositely disposed side surfaces, said upper surface having a central longitudinal axis in a first imaginary plane extending from said upper surface to said lower surface, said lower surface being formed with a downwardly disposed planar wall, said downwardly disposed planar wall being perpendicularly disposed to a second imaginary plane being perpendicular to said first imaginary plane and extending through said side surfaces, a distal bottom wall at a first location being contiguous with said downwardly disposed planar wall, and an angular portion being contiguous with said distal bottom wall at a second location wherein said angular portion extending angularly disposed relative to said distal bottom wall and extends to said second imaginary plane, wherein said first and second locations being spaced from each other, said downwardly disposed planar wall being formed to about the index finger when the user grips the handle;

said upper surface being formed with a recess disposed adjacent the distal end, said recess comprising a thumb engaging surface;

a knife blade;

said handle being formed with means for securing said knife blade in said distal end;

said knife blade having an upper edge and a cutting edge, said knife blade upper edge being angularly disposed wherein the blade upper edge is angled from the handle and towards said second imaginary plane and subtends an angle of about 1° to 6°.

2. The ergonomic poultry knife of claim 1, wherein the blade upper edge angular disposition is about 3°.

3. The ergonomic poultry knife of claim 1, said recess surface being substantially more adjacent to the distal end than disposed planar wall.

4. The ergonomic poultry knife of claim 1, said upper surface having a portion adjacent said thumb engaging recess being formed to approximately contour the inside of a closed hand, whereby the hand grip pressure exerted is evenly distributed.

5. The ergonomic poultry knife of claim 1, said lower surface having a bottom end portion contiguous with said downwardly disposed planar wall, said bottom end portion being disposed in a plane about paraliel to said second imaginary plane.

6. The ergonomic poultry knife of claim 4, said lower surface having a bottom end portion contiguous with said downwardly disposed planar wall, said bottom end portion being disposed in a plane about parallel to said second imaginary plane.

7. The ergonomic poultry knife of claim 6, said upper surface comprising a portion oppositely disposed from said lower surface portion, said upper surface portion comprises a longitudinally extending curved portion extending upwardly away from said second imaginary plane.

8. The ergonomic poultry knife of claim 1, said blade being angularly disposed immediately adjacent said handle distal end.

9. The ergonomic poultry knife of claim 1, said handle distal end having a transversely disposed arcuate curvature and wherein the axis of the radius of said arcuate curvature is disposed in a plane, and said downwardly disposed planar wall being disposed in said plane.

10. An ergonomic poultry knife comprising:

a handle having a proximate end and a distal end, an upper surface and an oppositely disposed lower surface, and oppositely disposed side surfaces, said upper surface having a central longitudinal axis in a first imaginary plane extending from said upper surface to said lower surface, said lower surface being formed with a downwardly disposed planar wall, said downwardly disposed planar wall being perpendicularly disposed to a second imaginary plane being perpendicular to said first imaginary plane and extending through said side surfaces, a distal bottom wall at a first location being contiguous with said downwardly disposed planar wall, and an angular portion being contiguous with said distal bottom wall at a second location wherein said angular portion extending angularly disposed relative to said distal bottom wall and extends to said second imaginary plane, wherein said first and second locations being spaced from each other, said downwardly disposed planar wall being formed to abut the index finger when the user grips the handle;

said upper surface being formed with a recess disposed adjacent the distal end, said recess comprising a thumb engaging surface;

a knife blade; said handle being formed with means for securing said knife blade in said distal end;

said knife blade having an upper edge and a cutting edge, said knife blade upper edge being angularly disposed wherein the blade upper edge is angled from said handle and towards said second imaginary plane and subtends an angle of about 1° to 6°, said sides being formed with oppositely disposed recesses for alternately receiving the users thumb; and wherein the plane of said downwardly disposed planar wall bisects the oppositely disposed recesses.

* * * * *